US005785231A

United States Patent [19]

Lee

[11] Patent Number: 5,785,231

[45] Date of Patent: Jul. 28, 1998

[54] EJECTION SWITCH FOR NAILER

[76] Inventor: Yun-Chung Lee, 3F No. 117, Yuchoko Tan Shui Jen Taipei Hsien, Taiwan

[21] Appl. No.: 940,837

[22] Filed: Sep. 30, 1997

[51] Int. Cl.[6] ..... B25C 1/04

[52] U.S. Cl. ..... 227/130; 227/8; 91/308

[58] Field of Search ..... 227/130, 8; 91/307, 91/308, 309, 317

[56] References Cited

U.S. PATENT DOCUMENTS

| | | | |
|---|---|---|---|
| 4,811,882 | 3/1989 | Steeves et al. | 227/8 |
| 5,131,579 | 7/1992 | Okushima et al. | 227/8 |
| 5,522,532 | 6/1996 | Chen | 227/8 |
| 5,597,106 | 1/1997 | Hamano et al. | 227/130 |
| 5,669,542 | 9/1997 | White | 227/130 |

*Primary Examiner*—Scott A. Smith

*Attorney, Agent, or Firm*—Pro-Techtor International Services

[57] ABSTRACT

The present invention relates to an ejection switch for a nailer, which allows for precise controlling of the ejection of nails by having a gliding bar vertically gliding within a gliding seat in a cavity on a valve seat, wherein, after ejecting a nail, the gliding seat moves against the gliding bar, such that the triggering of a loading state and of an ejection state follows the position of the moving bar in a hysteresis-like behavior and unwanted ejection of nails is prevented.

5 Claims, 5 Drawing Sheets

EJECTION SWITCH FOR NAILER

BACKGROUND OF THE INVENTION

1. Field of the Invention

The present invention relates to an ejection switch for a nailer, particularly to an ejection switch which allows for precise controlling of the ejection of nails.

2. Description of Related Art

When working with a nailer, the quality of the work usually depends on how nails are ejected by a trigger. So controlling the movement of the ejection switch is very important. As shown in FIG. 5, a conventional ejection switch for controlling the flow of compressed air to and from a head valve of a pressure cylinder of a nailer comprises a lower valve body 1 with an air outlet 4 and an upper valve body 2 with an air inlet 5. The lower and upper valve bodies 1, 2 are connected to each other, forming a valve seat. The air inlet 5 is connected to an compressed-air path 9A. A moving bar 7 controls opening and closing of the air inlet 5 and of the air outlet 4. The lower and upper valve bodies 1, 2 enclose a cavity 3. On one side of the cavity 3, a valve opening 6 is mounted, which is connected to the head valve of the pressure cylinder. Compressed air passes through the inlet 5 of the upper valve body 2 and enters the head valve through the valve opening 6, closing the entrance of the pressure cylinder and preparing the next ejection of a nail in a loading state. When the moving bar 7 moves up, the inlet 5 of the upper valve body 2 is closed, cutting the flow of compressed air through the valve opening 6 into the head valve, at the same time opening the outlet 4 of the lower valve body 1 and releasing compressed air contained in the head valve. Then the entrance of the pressure cylinder is enabled to open and release another nail in an ejection state. Then the moving bar 7 moves down, closing the outlet 4 of the lower valve body 1 and opening the inlet 5 of the upper valve body 2, allowing compressed air to enter the head valve, for another loading state. Although this method of controlling the ejection of nails works, the moving bar opens the inlet 5 and closes the outlet 4 at almost the same time. When compressed air is to be let into the head valve, the moving bar 7 needs to move down only a little. The trigger points of the moving bar 7 for the ejection state and, on its way back, for the loading state are almost the same. This makes the ejection of nails not only hard to control, but also a slight, inadvertent pushing up of the moving bar 7, just after having passed the trigger point, causes a nail to be ejected into a wrong place.

For better control of the ejection of nails, an improved ejection switch has been devised, wherein the moving bar is substituted by two independent moving bar sections resulting in different trigger points for the ejection state and the loading state. However, this kind of ejection switch has a complicated structure.

SUMMARY OF THE INVENTION

The object of the present invention is to provide an ejection switch for a nailer of simple structure, which allows to control precisely the movement of the ejection of nails.

The present invention can be more fully understood by reference to the following description and accompanying drawings.

DETAILED DESCRIPTION OF THE PREFERRED EMBODIMENT

The ejection switch of the present invention controls the flow of compressed air from a compressed-air path to and from and from a head valve of a pressure cylinder for ejecting a nail. As shown in FIGS. 1–4, the ejection switch of the present invention mainly comprises: a valve seat 10; a gliding seat 20; and a vertically movable moving bar 30. The moving bar 30 controls the flow of compressed air. In a lower position of the moving bar 30, in a loading state, compressed air is let into the head valve as a preparation for ejecting a nail. In a higher position of the moving bar 30, in an ejection state, compressed air is released from the head valve. The triggering of the loading state and of the ejection state follows the position of the moving bar 30 in a hysteresis-like behavior. This ensures accurate control of the ejection of nails.

Figure 1:
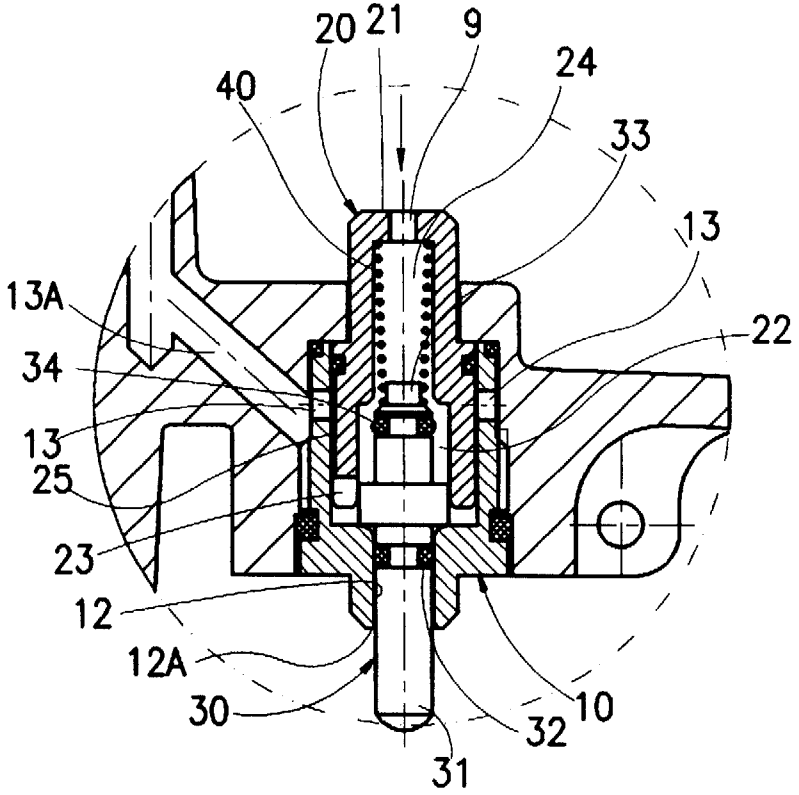
FIG. 1 is a sectional view of the present invention, showing the assembly of the structural parts thereof.
Figure 2:
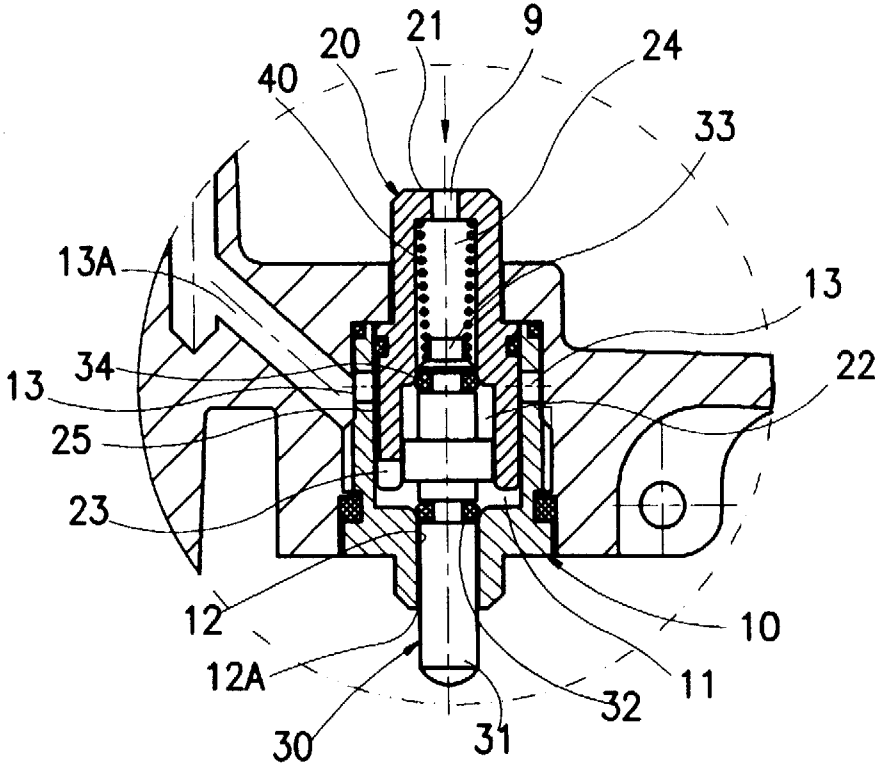
FIG. 2 is a sectional view of the present invention at the trigger point for ejecting a nail.

Referring to Figs.1–2 the valve seat 10 is a hollow, vertically extended body with an upper side, which forms a cavity 11, and a lower side, which has a first hole 12. The side wall of the cavity 11 is passed through by at least one valve opening 13. The openings 13 connect to an air path 13A, which leads to the head valve of the pressure cylinder. The first hole 12 leads to the cavity 11, both of them surrounding the moving bar 30.

Figure 3:
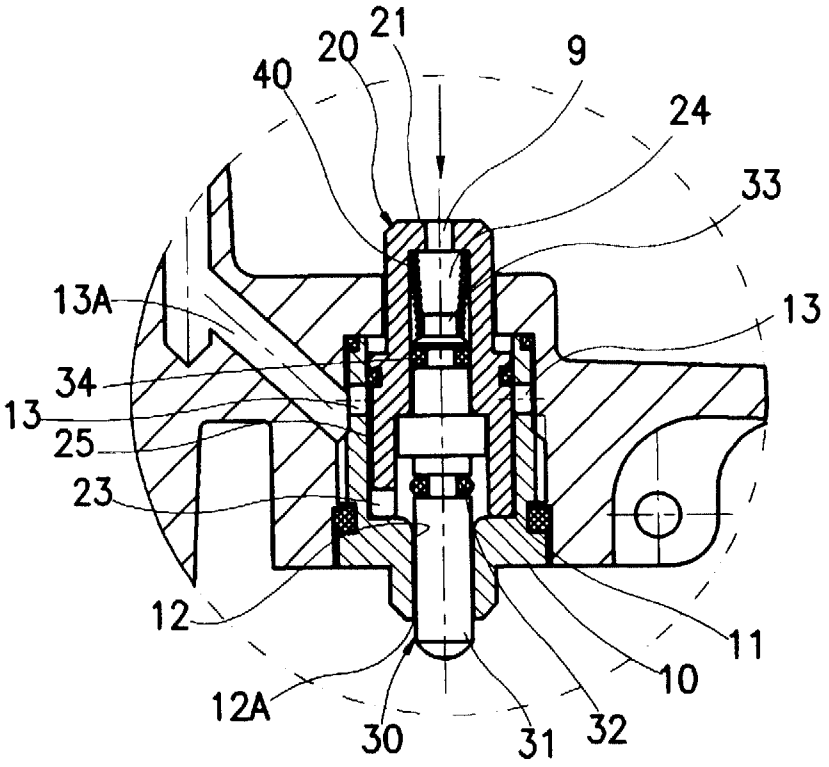
FIG. 3 is a sectional view of the present invention, when a nail is ejected.
Figure 4:
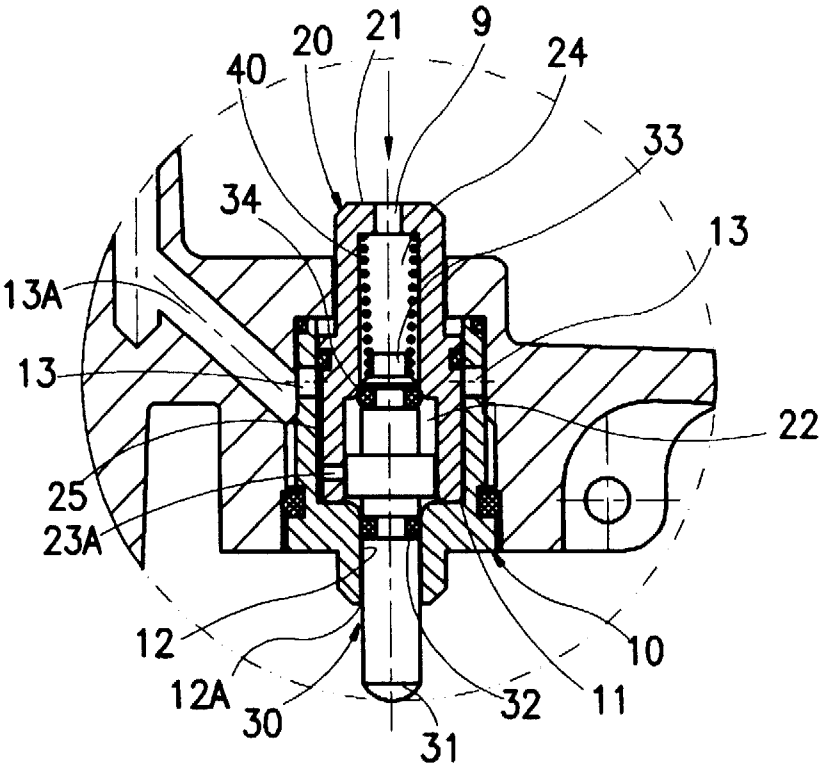
FIG. 4 is a sectional view of the present invention at the trigger point for preparing another ejection.
Figure 6:
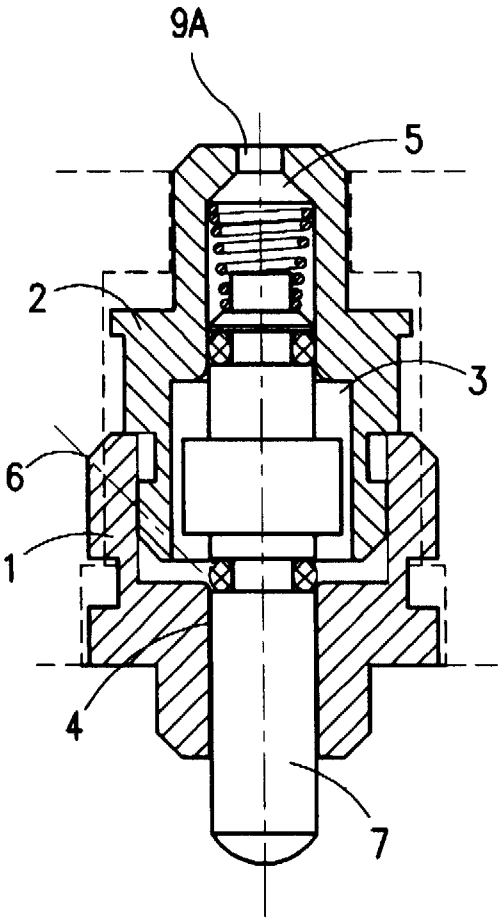
PRIOR ART FIG 6
FIG. 6 is a sectional view of a conventional ejection switch at the trigger point for ejecting a nail.
Figure 5:
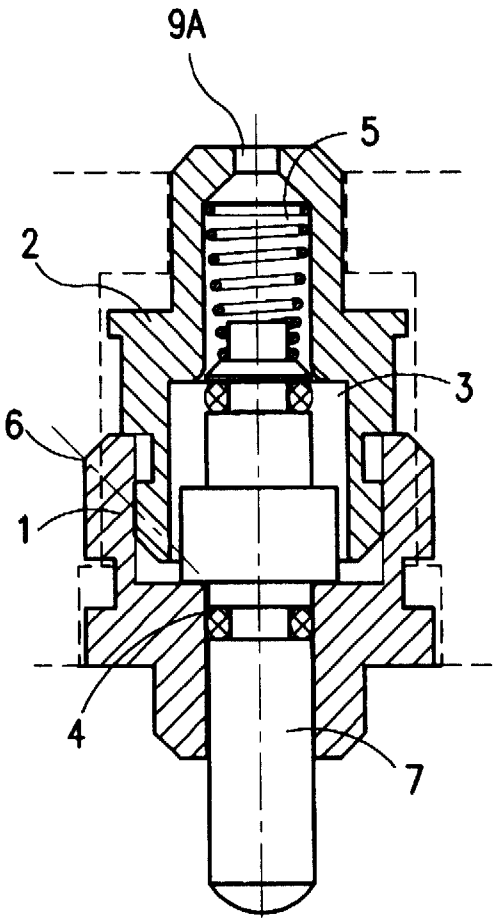
PRIOR ART FIG 5
FIG. 5 is a sectional view of a conventional ejection switch.

The moving bar 30 has an elongated shape, with a lower part 3.1 extending through the first hole 12 beyond the lower side of the valve seat 10, and gliding therein. Above the lower part 31, the moving bar 30 has a first sealing element 32. The first sealing element 32 leans against the walls of the first hole 12, if the moving bar 30 is in a low position (as shown in FIGS. 1 and 4), or is located freely in the interior of the cavity 11, if the moving bar 30 is in a high position (as shown in FIGS. 2 and 3). At this time, a peripheral slit 12A surrounds the lower part 31 of the moving bar 30 within the first hole 12.

The moving bar 30 further has a top part 33, with a second sealing element 34 placed below the top part 33. The top part 33 and the second sealing element 34 are located within the gliding seat 20.

The gliding seat 20 is an elongated body with a lower part that is glidingly mounted in the cavity 11. The gliding seat 20 further has an upper part, which is connected to the compressed-air path, and a top side 21, pressed on by compressed air. An inner cavity 22 is located in the lower part of the gliding seat 20. The inner cavity has sidewalls, passed through by a plurality of air holes 23A (as shown in FIG. 4). Alternatively, a plurality of air holes 23 pass through the sidewalls of the inner cavity 22 close to the lower edge thereof (as shown in FIG. 1). The plurality of air holes 23 or 23A connect the interior of the inner cavity 22 through a peripheral slit 25 between the gliding seat 20 and the valve seat 10 to the openings 13, establishing a connection between the cavity 22 and the head valve.

The top side 21 and the upper part of the gliding seat 20 are passed through by a second hole 24, which towards the lower side widens in a step and is aligned with the first hole 12, allowing compressed air from the compressed-air path 9 to enter the inner cavity 22. The second sealing element 34 either leans against the walls of the second hole 24, when the moving bar 30 has moved up, or is located freely in the interior of the inner cavity 22, when the moving bar 30 has moved down. When the moving bar 30 moves up and the first sealing element 32 just leaves the first hole 12, the second sealing element 34 enters the second hole 24, interrupting the flow of compressed air from the compressed-air path 9 into the inner cavity 9. The compressed air from the head valve is released through the peripheral slit 12A in the first hole 12 (as shown in FIG. 3), causing the pressure cylinder to release a nail. After compressed air in the head valve has been released, the inner cavity 22 no longer is under high air pressure, and the gliding seat 20 is pushed down by compressed air from the compressed-air path 9. When, in this state, the moving bar 30 moves down, the second sealing element 34 leaves the second hole 24 only after the first sealing element 32 has entered the first hole 12. Then compressed air is led to the head valve again for returning to the loading state. At the same time, the inner cavity 22 is filled with compressed air again.

Referring to FIGS. 1–4, the gliding seat 20 ensures that, after ejecting a nail, the moving bar 30 has to travel down an extra distance, before compressed air is let into the head valve for the loading state. The triggering of the loading state and of the ejection state follows the position of the moving bar 30 in a hysteresis-like behavior. This makes ejecting nails easier to control with a relatively simple structure.

In order to return the gliding seat 20 to its original position, after a nail has been ejected, a spring 40 is mounted on the top part 33 of the gliding bar 30. The sprint 40 is helical, having one end leaning against the top part 33 of the gliding bar 30 and the other end against the step of the second hole 24. When compressed air has entered the inner cavity 22, causing a pressure equilibrium inside and outside the inner cavity 22, the spring 40 pushes the gliding seat 20 up into its original position.

I claim:

1. An ejection switch for a nailer, leading compressed air from a compressed-air path to a head valve of a pressure cylinder in a loading state for preparing an ejection of a nail or releasing compressed air from said head valve in an ejection state for ejecting said nail, said ejection switch comprising:

a valve seat with an upper side and a lower side, mounted on said nailer, having a cavity, which is open to said upper side and has a sidewall, and a first hole in said lower side, which is connected to said cavity, with at least one valve opening passing through said sidewall;

a gliding seat, vertically glidingly mounted in said cavity of said valve seat, having an upper end with a top side passed through by a second hole, which is aligned with said first hole, and a lower end with an inner cavity; and a moving bar, gliding in said valve seat and said gliding seat with a vertical position, having a lower part extending beyond said first hole of said valve seat and a top part within said second hole of said gliding seat, with a first sealing element above said lower part sealing said first hole or freely located in said cavity, depending on said vertical position, and a second sealing element below said top part freely located in said inner cavity or sealing said second hole, depending on said vertical position;

wherein in said ejection state, said vertical position of said moving bar is high, said second sealing element seals said second hole, compressed air is released through said first hole, and said gliding seat is pushed down by compressed air from said compressed-air path, such that, when said moving bar moves down for entering said loading state, said second sealing element leaves said second hole only after said first sealing hole has entered said first hole, and triggering of said loading state and of said ejection state follows said vertical position of said moving bar in a hysteresis-like behavior, making ejecting nails easier to control.

2. An ejection switch for a nailer according to claim 1, wherein said second hole has an upper section, which passes through said top side of said gliding seat and is relatively narrow.

3. An ejection switch for a nailer according to claim 2, wherein a spring is mounted inside said second hole, pushing up said gliding seat, after said loading state has been entered.

4. An ejection switch for a nailer according to claim 1, wherein said first and second sealing elements are O-rings.

5. An ejection switch for a nailer according to claim 1, wherein said gliding seat has a sidewall with a lower peripheral edge, said sidewall of said gliding seat at said lower edge or at a distance from said lower edge being passed through by a plurality of air holes.

* * * * *